US010807774B2

(12) United States Patent
Warner et al.

(10) Patent No.: US 10,807,774 B2
(45) Date of Patent: Oct. 20, 2020

(54) CONTAINER WITH A CHILD-RESISTANT LID

(71) Applicant: ASSURPACK LLC, Greenwood Village, CO (US)

(72) Inventors: Nancy Warner, Greenwood Village, CO (US); Jeremiah Buck, Wheat Ridge, CO (US)

(73) Assignee: Assurpack LLC, Greenwood Village, CO (US)

( * ) Notice: Subject to any disclaimer, the term of this patent is extended or adjusted under 35 U.S.C. 154(b) by 0 days.

(21) Appl. No.: 16/430,500

(22) Filed: Jun. 4, 2019

(65) Prior Publication Data

US 2019/0283941 A1 Sep. 19, 2019

Related U.S. Application Data

(60) Provisional application No. 62/695,366, filed on Jul. 9, 2018.

(51) Int. Cl.
*B65D 50/06* (2006.01)
*B65D 43/16* (2006.01)

(52) U.S. Cl.
CPC ..... *B65D 50/06* (2013.01); *B65D 43/163* (2013.01); *B65D 2215/04* (2013.01)

(58) Field of Classification Search
CPC .. B65D 50/06; B65D 43/163; B65D 2215/04; B65D 50/066; B65D 50/067; B65D 50/068; B65D 50/069
(Continued)

(56) References Cited

U.S. PATENT DOCUMENTS 4,146,146 A 3/1979 Mar
4,203,532 A 5/1980 Mar
(Continued)

*Primary Examiner* — Andrew D Perreault
(74) *Attorney, Agent, or Firm* — John H. Choi & Associates

(57) ABSTRACT

A lid opens and closes a container which has first walls forming an interior. The lid includes a lower member and an upper member. The lower member has a plurality of edges forming an aperture for accessing the interior of the container when the lid is in an open configuration. The upper member has a distal end; a hinge rotatably engaging the lower member wherein the distal end of the upper member rotates towards the lower member when the lid is in a closed configuration, and wherein the distal end rotates away from the lower member when the lid is in the open configuration; a downwardly extending second wall for closing the aperture when the lid is in the closed configuration, and for opening the aperture when the lid is in the open configuration; an abutment; a resilient member engaging the abutment; and a protrusion coupled to the resilient member and engaging a first edge of the lower member when the lid is in the closed configuration; and a button coupled to the resilient member, with the button in a first position for applying a force to the resilient member to move the protrusion away from the first edge to place the lid in the open configuration, and the button in a second position for not applying the force to the resilient member, wherein a restorative force of the resilient member against the abutment causes the protrusion to engage the first edge to place the lid in the closed configuration.

6 Claims, 10 Drawing Sheets

(58) Field of Classification Search
USPC ..... 220/813, 254.3, 254.9, 345.1; 215/213
See application file for complete search history.

(56) References Cited

U.S. PATENT DOCUMENTS

| | | | | |
|---|---|---|---|---|
| 4,512,484 | A | 4/1985 | Mar | |
| 5,887,736 | A | 3/1999 | Mar | |
| 6,367,639 | B1 * | 4/2002 | Mar | B65D 50/066 215/211 |
| 9,120,605 | B1 | 9/2015 | Mar | |
| 9,266,649 | B1 | 2/2016 | Mar | |
| 2013/0248531 | A1 * | 9/2013 | Lane | A47J 47/02 220/262 |
| 2016/0023816 | A1 * | 1/2016 | Giraud | B65D 50/066 220/263 |
| 2018/0086518 | A1 * | 3/2018 | Charm | B26D 1/0006 |

* cited by examiner

CONTAINER WITH A CHILD-RESISTANT LID

CROSS-REFERENCE TO RELATED APPLICATION

This application claims priority to U.S. Provisional Application No. 62/695,366, filed on Jul. 9, 2018, which is incorporated by reference in its entirety.

FIELD

The present disclosure relates to child-resistant containers and in particular to a container with a child-resistant lid.

BACKGROUND

Child-resistant containers allow adult users to store materials which would be unsafe for consumption or use by children, by requiring manipulation of a cap or lid of the container with sufficient force to open the container and which a child cannot attain. Typically, such caps or lids are circular, requiring rotation of the cap to open the container. However, such circular caps or lids have relatively large widths and are not very compact, increasing manufacturing costs and also adding bulk to the product. Other child resistant caps or lids are difficult to use due to the configuration of the locks.

Typical child-resistant containers in the prior art also lack discreetness in that others are likely to presume that medicine or other substances are contained therein. Users of those containers may not wish to have others view the user as being on medication or having or using such other substances.

A need exists, therefore, for a non-traditional, e.g., non-circular cap or lid for a container, which is child-resistant, compact, easy to use and discreet.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

A child-resistant container of the present invention has a substantially linear profile with a longitudinally extending lid on a container body. The lid is opened by moving a button longitudinally to disengage an edge portion of an upper member from a lower member, allowing a distal end of the upper member to be rotated away from the lower member, thereby exposing an aperture for accessing the contents of the container body.

In one embodiment, the present invention is a lid for a container having a plurality of first walls forming an interior. The lid includes a lower member and an upper member. The lower member has a plurality of edges forming an aperture for accessing the interior of the container when the lid is in an open configuration. The upper member has a distal end; a hinge rotatably engaging the lower member wherein the distal end of the upper member rotates towards the lower member when the lid is in a closed configuration, and wherein the distal end rotates away from the lower member when the lid is in the open configuration; a downwardly extending second wall for closing the aperture when the lid is in the closed configuration, and for opening the aperture when the lid is in the open configuration; an abutment; a resilient member engaging the abutment; and a protrusion coupled to the resilient member and engaging a first edge of the lower member when the lid is in the closed configuration; and a button coupled to the resilient member, with the button in a first position for applying an opening force to the resilient member to move the protrusion away from the first edge to place the lid in the open configuration, and with the button in a second position for not applying the opening force to the resilient member, wherein a restorative force of the resilient member against the abutment causes the protrusion to move toward and engage the first edge of the lower member to place the lid in the closed configuration. The abutment includes a central portion engaging the resilient member. The abutment includes at least one side portion abutting the central portion for reinforcing the central portion. Alternatively, the abutment includes a central portion engaging the resilient member; and a pair of side portions laterally abutting the central portion for reinforcing the central portion.

In another embodiment, the present invention is a lid for a container which includes a lower member and an upper member. The lower member has a side portion engaging an opening of the container; and an interior portion forming an aperture operatively connected to an interior of the container. The upper member has a rear portion having a hinge rotatably coupled to the lower member; and a front portion having a slidable member with a first detent for engaging the interior portion; and a base for complementarily resting in the aperture, thereby closing the container. Sliding movement of the slidable member in a longitudinal direction causes the first detent to disengage from the interior portion to allow the upper member to rotate about the hinge to move the front portion away from the lower member, thereby opening the container. The side portion removably engages the opening of the container. The side portion has a second detent for frictionally engaging a side of the container, thereby retaining the lower member in a coupled engagement with the container. The upper member includes a button connected to the slidable member, and responsive to a sliding force for sliding the slidable member longitudinally toward the rear portion. The button includes a ridge for allowing a user to grip the button to apply the sliding force. The front portion includes an abutment; and a resilient member contacting the abutment and connected to the slidable member for biasing the slidable member longitudinally away from the rear portion. The resilient member biases the slidable member to apply a restorative force opposite to the sliding force. The resilient member restores the slidable member to an initial position when the sliding force is not applied to the button.

In a further embodiment, the present invention is a box which includes a container having an opening on one side; and a lid. The lid includes a lower member and an upper member. The lower member has a side portion engaging the opening of the container; and an interior portion forming an aperture operatively connected to an interior of the container. The upper member has a rear portion having a hinge rotatably coupled to the lower member; and a front portion having a slidable member with a first detent for engaging the interior portion; and a base for complementarily resting in the aperture, thereby closing the container; wherein sliding movement of the slidable member in a longitudinal direction causes the first detent to disengage from the interior portion to allow the upper member to rotate about the hinge to move the front portion away from the lower member, thereby opening the container. The side portion removably engages the opening of the container. The side portion has a second detent for frictionally engaging a side of the container, thereby retaining the lower member in a coupled engagement with the container. The upper member includes a button connected to the slidable member, and responsive to a sliding force for sliding the slidable member longitudinally toward the rear portion. The button includes a ridge for allowing a user to grip the button to apply the sliding force. The front portion includes an abutment; and a resilient member contacting the abutment and connected to the slidable member for biasing the slidable member longitudinally away from the rear portion. The resilient member biases the slidable member to apply a restorative force opposite to the sliding force. The resilient member restores the slidable member to an initial position when the sliding force is not applied to the button.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

Figure 1:
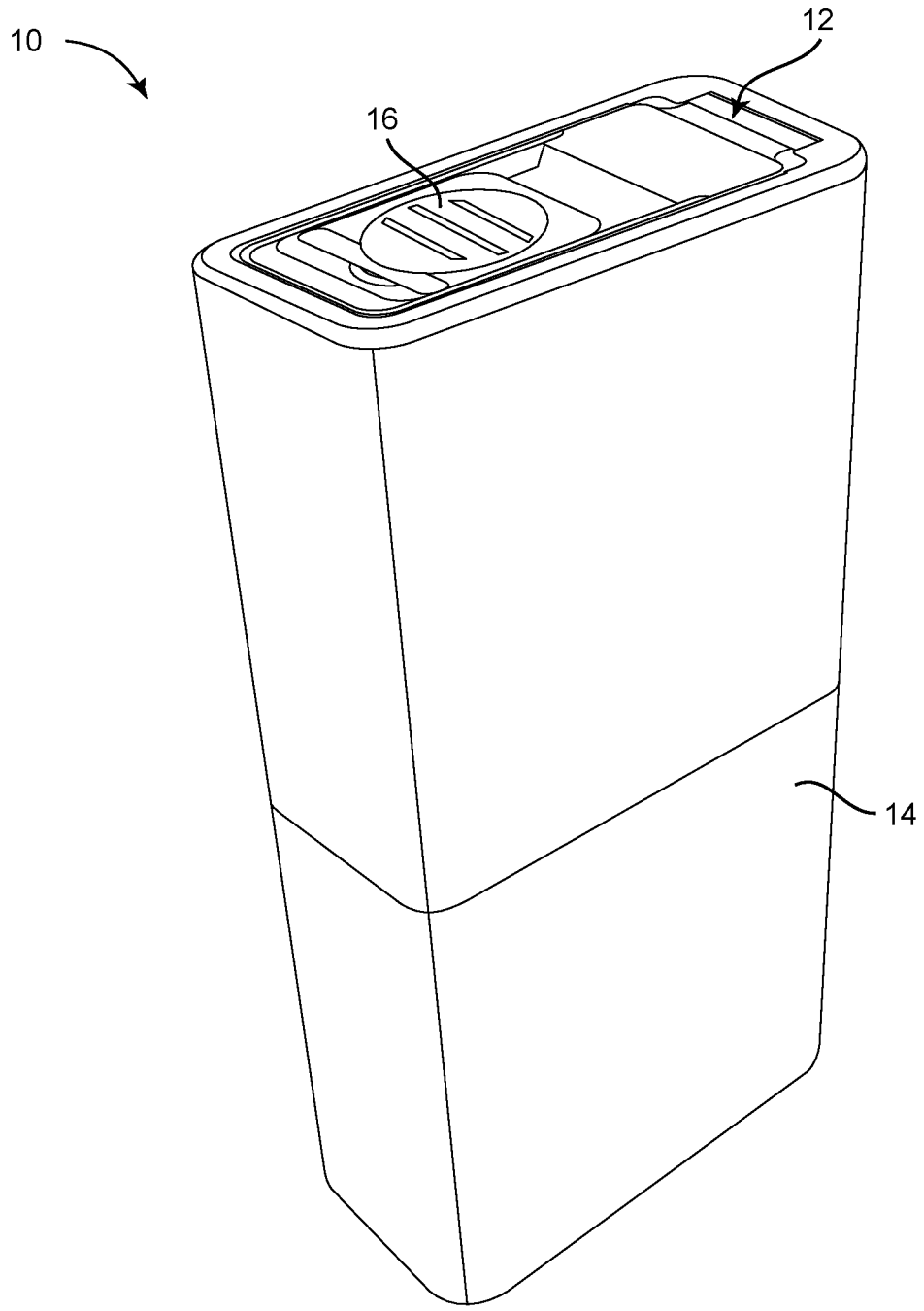
FIG. 1 is a top front side perspective view of the container of the present invention.

To facilitate an understanding of the invention, identical reference numerals have been used, when appropriate, to designate the same or similar elements that are common to the figures. Further, unless stated otherwise, the features shown in the figures are not drawn to scale but are shown for illustrative purposes only.

DETAILED DESCRIPTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left may be used to describe the accompanying figures. The terminology includes the words above specifically mentioned, derivatives thereof, and words of similar import.

Figure 2:
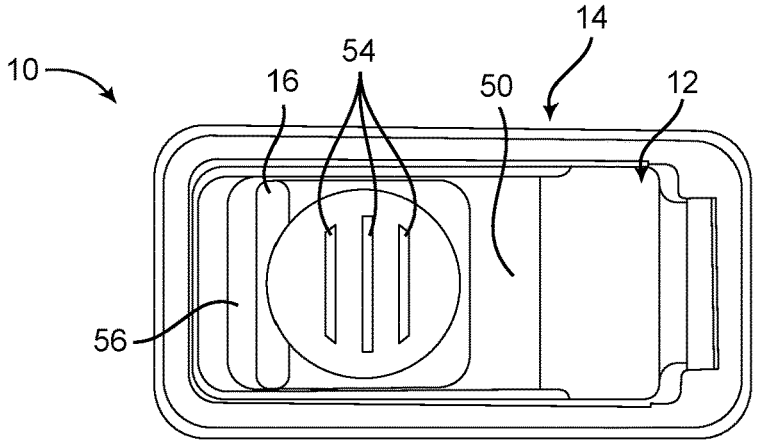
FIG. 2 is a top plan view of the container.
Figure 3:
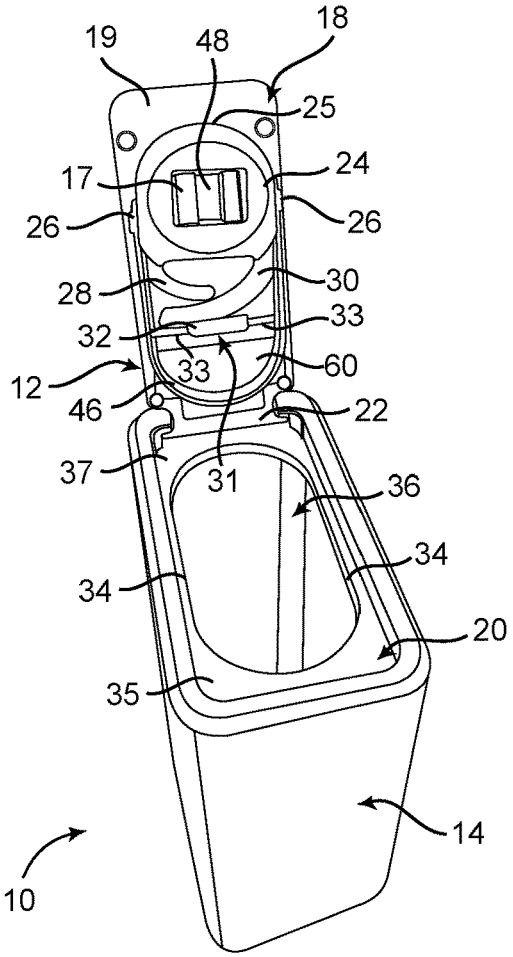
FIG. 3 is a top side perspective view of the container with the lid in an open configuration.

As shown in FIG. 1, the container 10 of the present invention includes a child-resistant lid 12 which longitudinally extends along the length of a container body 14. The lid 12 is removably mounted on the container body 14, with the child-resistant lid 12 having a movable button 16 for unlocking and opening the lid 12. FIG. 2 is a top plan view of the container 10 with the lid 12 removably mounted to the container body 14 and having the movable button 16 which moves longitudinally within a cavity 50 on an upper portion of the lid 12. At least one ridge 54 and/or a front detent 56 extend upward from the button 16, allowing a user to more easily grip and move the button 16 longitudinally within the cavity 50. As shown in FIG. 3, a bottom portion of the button 16 includes a pair of extensions 17 integrally formed with the button 16 and extending downwardly therefrom.

Figure 6:
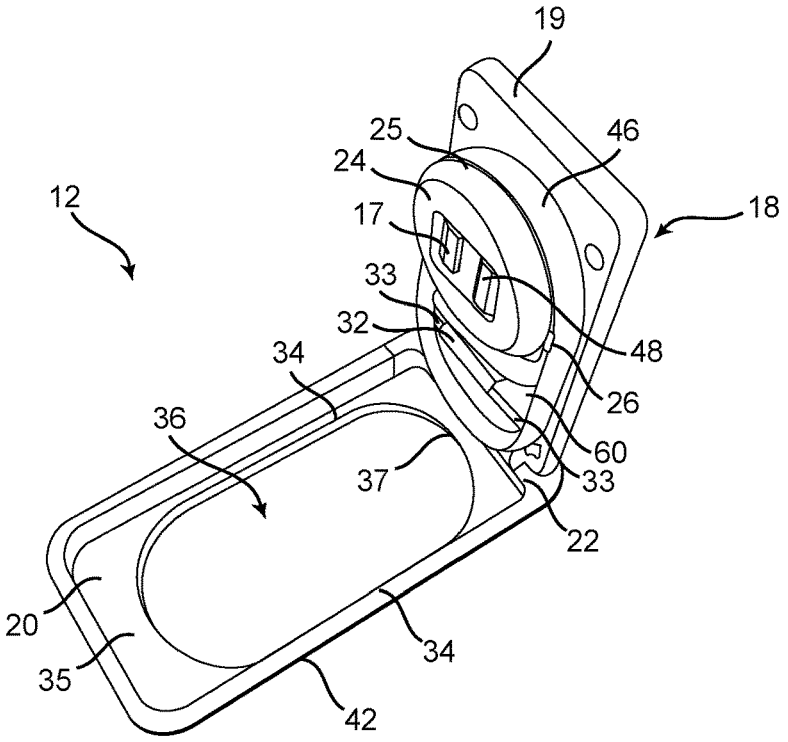
FIG. 6 is a top front side perspective view of the lid in an open configuration.
Figure 8:
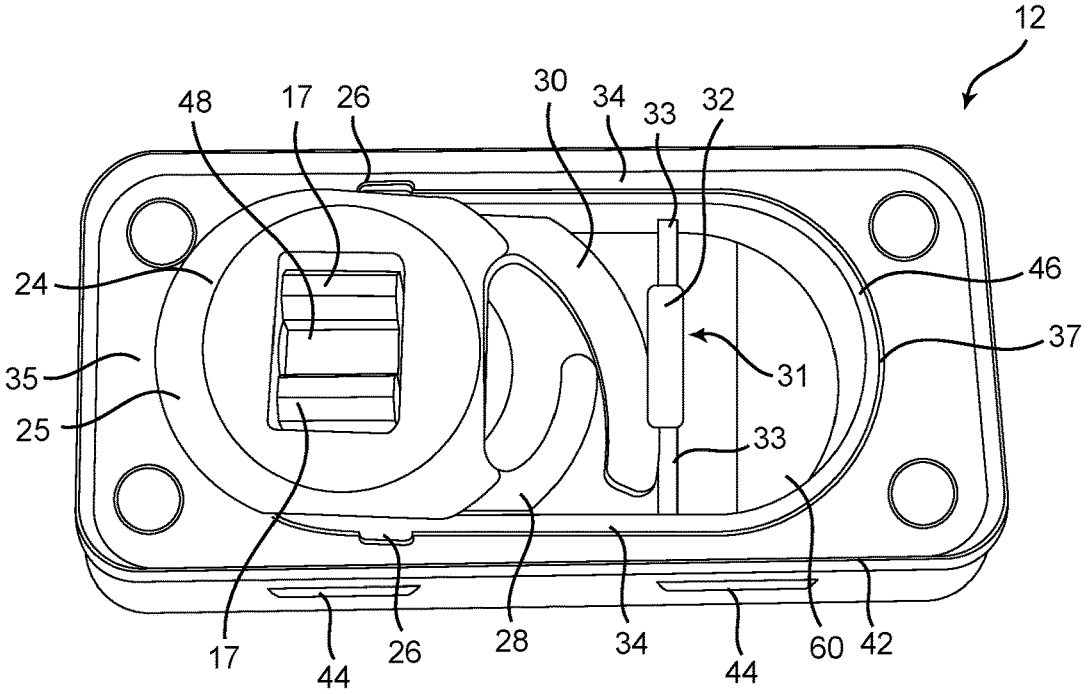
FIG. 8 is a bottom rear perspective view of the lid in a closed configuration.
Figure 9:
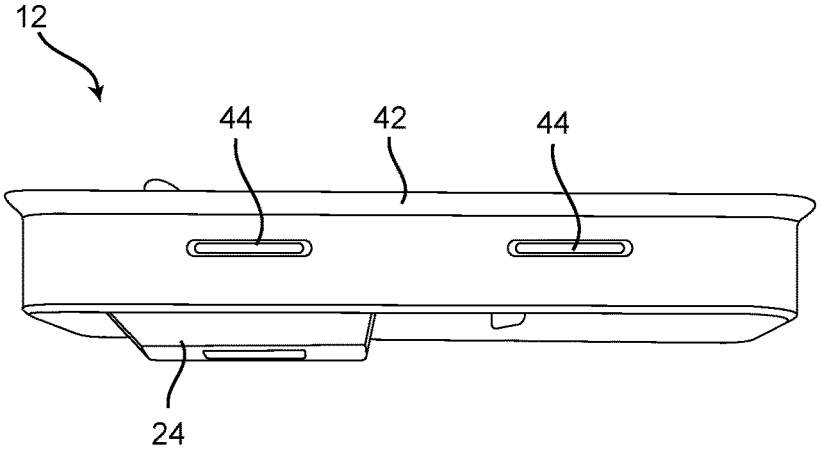
FIG. 9 is a front plan view of the lid in the closed configuration.

FIG. 3 is a top side perspective view of the container 10 with the lid 12 in an open configuration. The lid 12 has an upper member 18 rotatably mounted to a lower member 20 by a hinge 22. The hinge 22 may be a rotatable coupling of the upper member 18 to the lower member 20. Alternatively, the hinge 22 may be a resilient joint integrally coupling the members 18, 20 together. The upper member 18 includes a base 46 in the form of a downwardly extending wall forming a slot 60 for housing the button extensions 17 and a bottom member 24. Referring to FIGS. 3, 6, and 8, the base 46 includes an abutment 31 extending transversely between the base walls while protrusions 26 extend outward laterally from the base walls 46. The abutment 31 includes a central portion 32 engaging a resilient member 30, and a pair of side portions 33 laterally abutting the central portion 32 for reinforcing the structure of the central portion 32 as the resilient member 30 applies a force to the central portion 32, as described below.

As shown in FIG. 3, the bottom member 24 includes an aperture 48 and resilient members 28, 30 extend therefrom, with a first resilient member 28 slidably engaging the second resilient member 30, and the second resilient member 30 slidably engages at least the central portion 32 of the abutment 31 by applying a force to the central portion 32, such that the resilient members 28, 30 bias the bottom member 24 and the button 16 longitudinally away from the abutment 31 and/or the hinge 22. The bottom member 24 is attached to the button 16 by frictionally engaging the button extensions 17 which extend through the bottom member aperture 48. The bottom member 24 moves longitudinally parallel to the length of the upper member 18 as the movable button 16 is moved by the finger of a user using, for example, the at least one ridge 54 and/or the front detent 56, shown in FIG. 2. The bottom member 24 includes a top edge 25 opposite the resilient members 28, 30.

Still referring to FIG. 3, the lower member 20 has front and rear edges 34, a first side edge 35, and a second side edge 37 forming an aperture 36, allowing items kept within the interior of the container body 14 to be removed through the aperture 36 when a distal end 19 of the upper member 18 is rotated away from the lower member 20 to be in the open configuration of the lid 12. The edges 34 engage the protrusions 26, such that the protrusions 26 lock the upper member 18 to the lower member 20 in a friction fit when the upper member 18 is rotated downward to fit within the aperture 36 in the lower member 20, as shown in FIG. 8. As well, the bottom member top edge 25 extends beyond the base 46 above the first side edge 35 when the button 16 is disengaged, as shown for example in FIGS. 3, 6 and 8.

The purpose of the protrusions 26 shown in FIGS. 3, 6, 8, and 14 provides an additional level of lifting needed to open the lid 12. Without the protrusions 26, one may simply pull on the button 16 or slide the front detent 56, which is too easy for children to open. By adding the protrusions 26, the additional pressure from the protrusions 26 makes for a two-step, slide-and-pull-up opening, rather than just a slide opening or just a pull opening. The added protrusions 26 provide enough friction and enough needed cognitive ability from children such that testing showed a 94% Child-Resistant Effectiveness.

Figure 4:
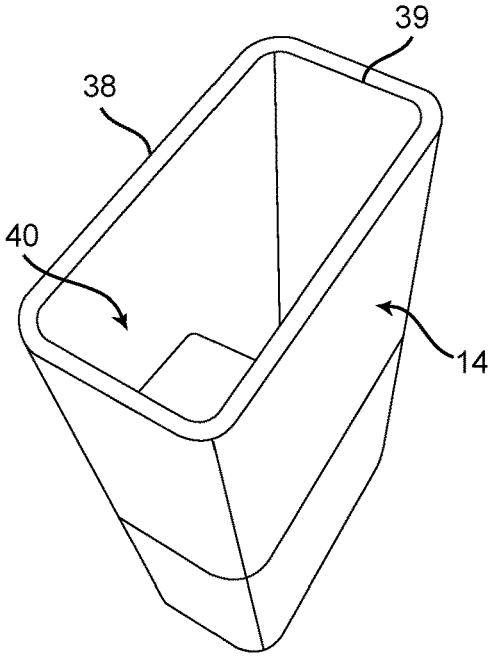
FIG. 4 is a top front side perspective view of the container without the lid.
Figure 5:
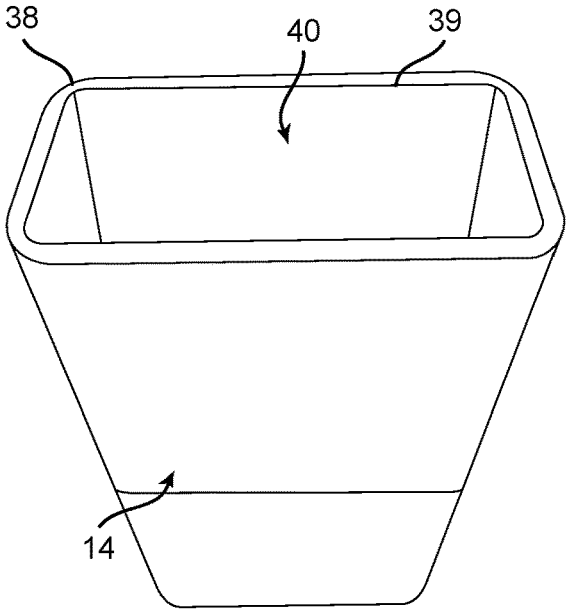
FIG. 5 is a top front perspective view of the container without the lid.
Figure 7:
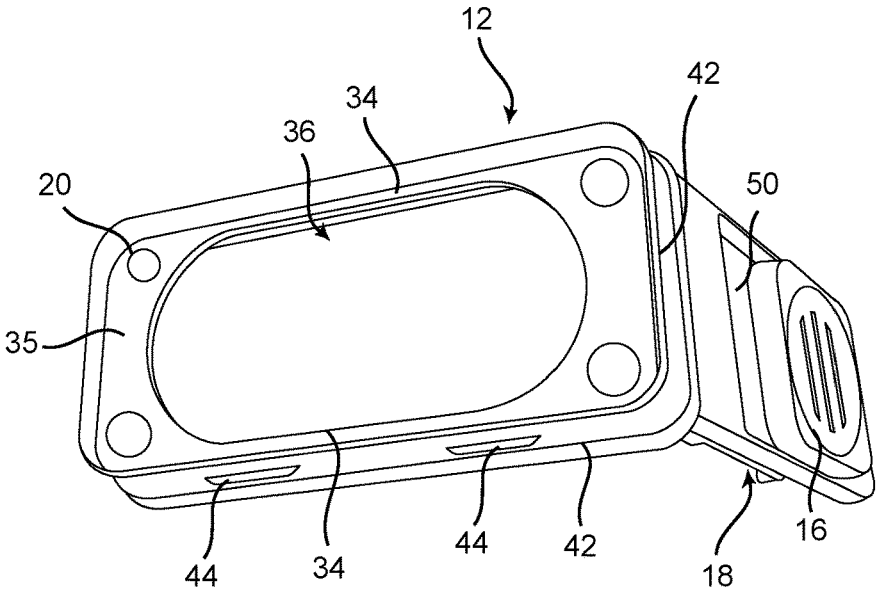
FIG. 7 is a bottom rear side perspective view of the lid in the open configuration.

FIGS. 4-5 are perspective views of the container body 14 without the lid 12, in which the container body 14 has an upper edge 38 and a lip 39 extending inwardly below the upper edge 38. The lip 39 is formed as at least a protrusion extending at least partially on or about the upper edge 38. The container body 14 also includes an interior 40 for receiving or dispensing items through the aperture 36 of the lid 12, as shown in FIGS. 3 and 6-7. Accordingly, the lip 39 may extend entirely around the perimeter formed by the upper edge 38. Alternatively, the lip 39 may only extend partially around the perimeter formed by the upper edge 38.

Figure 14:
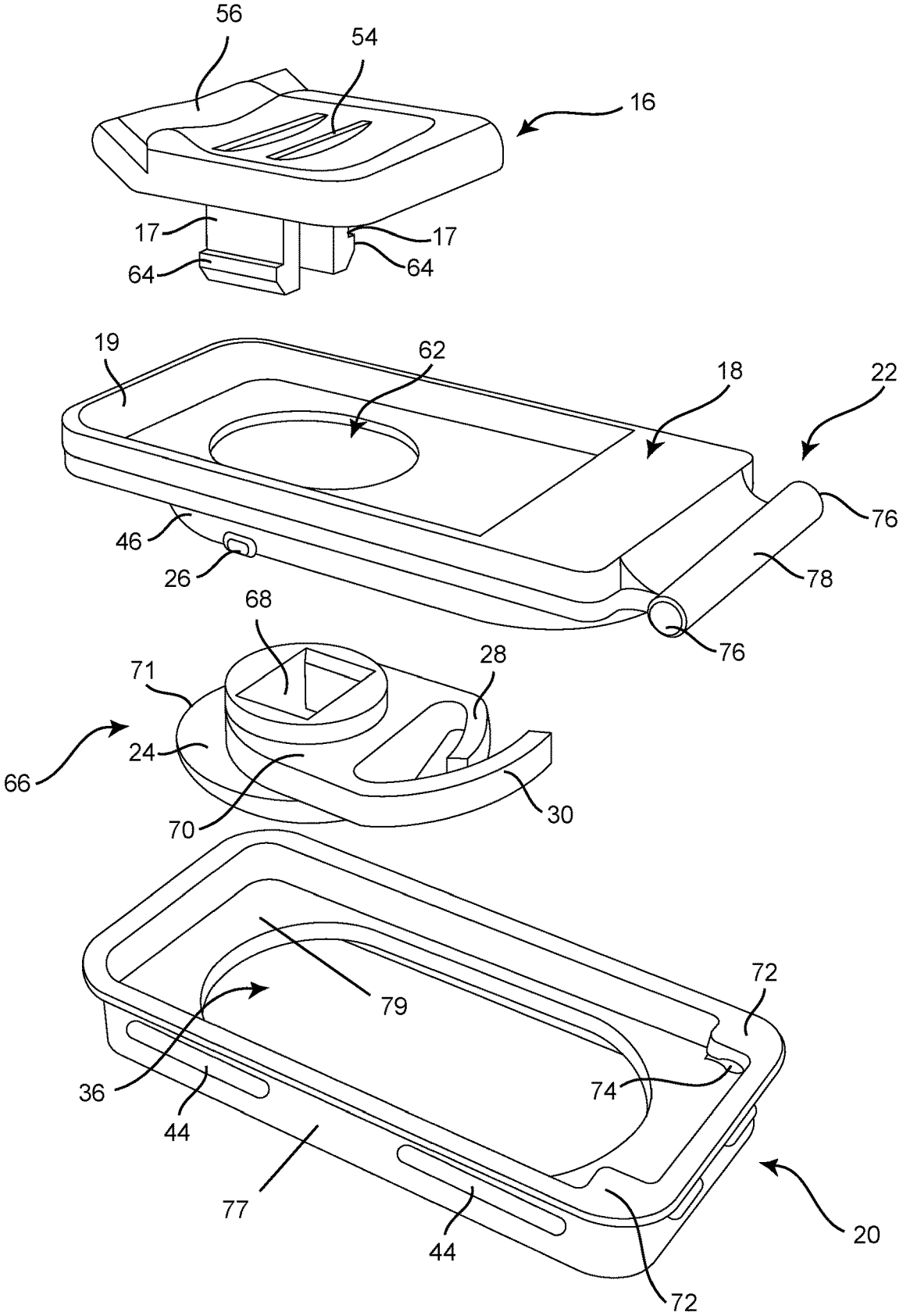
FIG. 14 is a top side rear perspective view of the lid of FIG. 10 with parts separated.

As shown in FIGS. 6-7 and 14, the lid 12 has an outer edge 42 for resting on the upper edge 38 of the container body 14, and the lid 12 further includes front and rear detents 44 disposed on a side portion 77 of the lower member 20 for engaging a bottom portion of the lip 39 of the container body 14 in a friction fit, such that the container body 14 retains the lid 12 thereupon. In an alternative embodiment, shown in FIGS. 10-14, the lid 12 includes additional side detents 52 disposed on the side portion 77 for further securing the lid 12 to the container body 14. In a further alternative embodiment, the detents 44, 52 may engage respective portions of the lip 39 which do not entirely extend around the perimeter of the upper edge 38.

Figure 10:
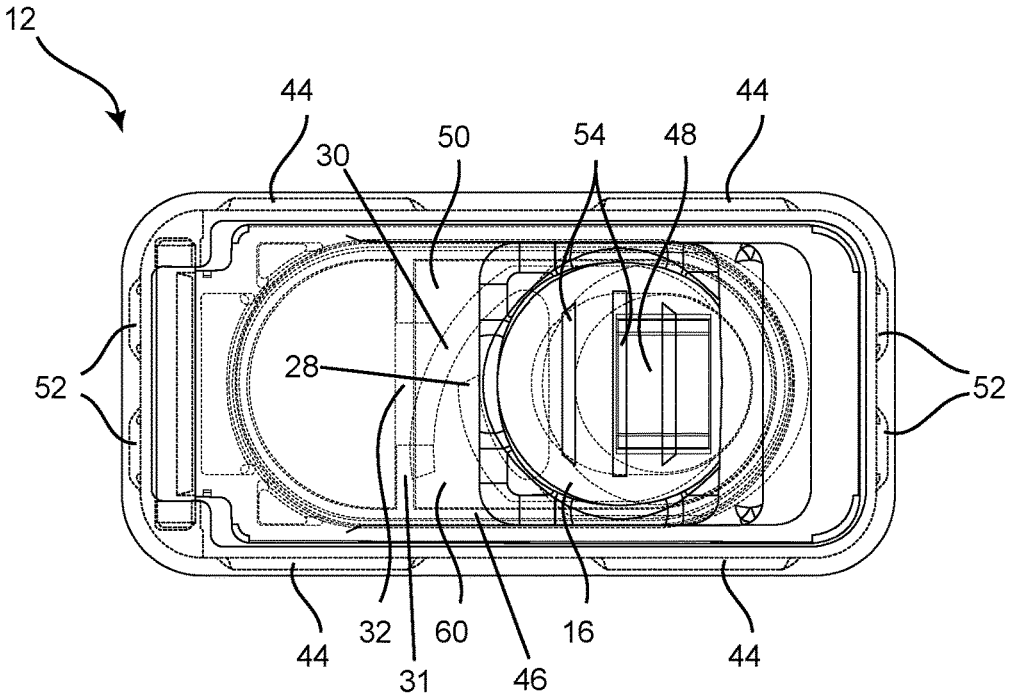
FIG. 10 is a top view of a lid of an alternative embodiment in a closed configuration with all parts of the lid superimposed.
Figure 11:
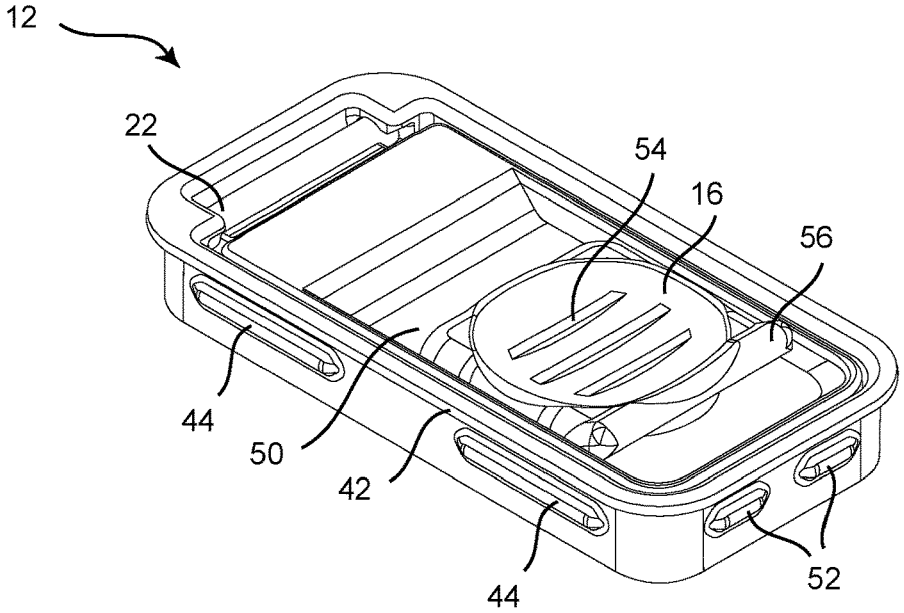
FIG. 11 is a top rear side perspective view of the lid of FIG. 10 in the closed configuration.
Figure 12:
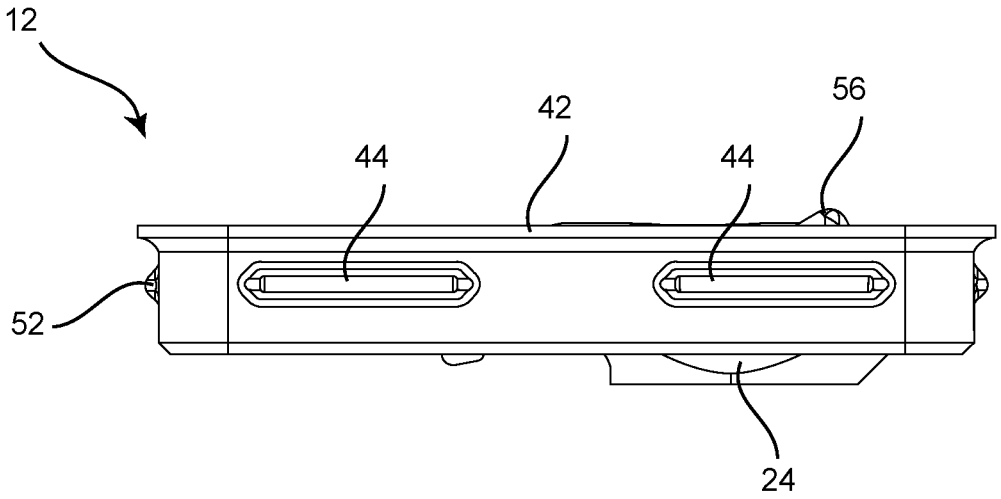
FIG. 12 is a rear plan view of the lid of FIG. 10 in the closed configuration.
Figure 13:
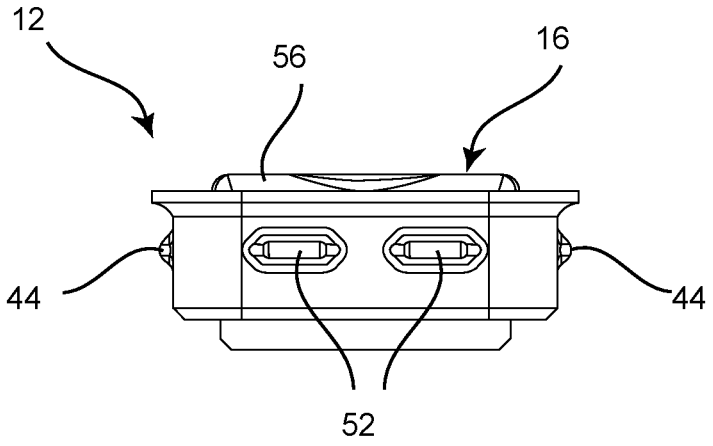
FIG. 13 is a side plan view of the lid of FIG. 10 in the closed configuration.

Referring to FIGS. 6-8 and 14, the bottom member 24 slidably engages the base 46 of the upper member 18, with the bottom member 24 operatively connected to the button 16 via extensions 17 through the bottom member aperture 48, shown for example in phantom in FIG. 10. When the button 16 is pushed longitudinally by the user towards the abutment 31 and/or the hinge 22, the bottom member 24 moves towards the abutment 31 within a slot 60 and compresses the resilient members 28, 30, while the top edge 25 of the bottom member 24 is substantially aligned with the base 46, allowing the upper member 18 to be pivoted away from the lower member 20 to have the upper member 18 in an open configuration with the aperture 36 which extends through the interior portion 79 of the lower member 20, such that the aperture 36 is cleared of the lid 18, as shown in FIGS. 3 and 6-7. As well, the protrusions 26 are disengaged from the edges 34.

Referring to FIGS. 8 and 14, subsequent release of the button 16 by the user will allow the restorative force of the resilient members 28, 30 to move the bottom member 24 and the button 16 longitudinally away from the abutment 31 and/or the hinge 22, and to move the top edge 25 to engage a lower surface of the first side edge 35 when the upper member 18 is pivoted toward the lower member 20 to close the aperture 36 extending through the interior portion 79, while the protrusions 26 engage lower surfaces of the front and rear edges 34, thereby locking the upper member 18 to the lower member 20 to close and lock the lid 12. FIG. 8 is a bottom rear perspective view of the lid 12 in a closed configuration, with the top edge 25 of the bottom member 24 engaging the first side edge 35 while the resilient members 28, 30 apply a restorative force to the bottom member 24 directed away from the abutment 31 and/or the hinge 22.

FIGS. 10-13 show an alternative embodiment of the lid 12 in the closed configuration with the front and rear detents 44, and the side detents 52 extending from walls of the lower member 20 of the lid 12. An example height of the lid 12 is about 0.775 cm (about 0.305 inches). The button 16 may include the front detent 56 extending upward from the button 16, and the button 16 may also include at least one ridge 54 for gripping by a user to open the lid 12 as the button 16 is pushed back toward the hinge 22. FIG. 10 is a top view of the lid 12 in the closed configuration, showing the components of the lid 12 in phantom, including the slot 60 on the bottom portion of the upper member 18 in which the button 16 moves longitudinally within the cavity 50 on the top portion of the upper member 18, shown in FIGS. 2 and 10-11. The longitudinal length of the lid 12 is, for example, about 3.787 cm (about 1.491 inches), and the width of the lid 12 is, for example, about 1.885 cm (about 0.742 inches). As shown in FIG. 10, the abutment 31 extends from opposing walls of the base 46, with the resilient member 30 engaging the central portion of the abutment 32.

FIG. 14 is a top side rear perspective view of the lid 12 of FIG. 10 with parts separated, showing the lid 12 having the button 16 insertable into an aperture 62 of the upper member 18, with tabs 64 on a lower portion of the extensions 17 of the button 16. The tabs 64 are capable of engaging a body 66 having the resilient members 28, 30 and forming the bottom member 24. The tabs 64 are inserted into and are retained by a slot 68 in the body 66 in a force-fit engagement. The hinge 22 of the upper member 18 is capable of being inserted into and retained by at least one hinge slot 74 in the lower member 20 in a force-fit engagement.

Figure 15:
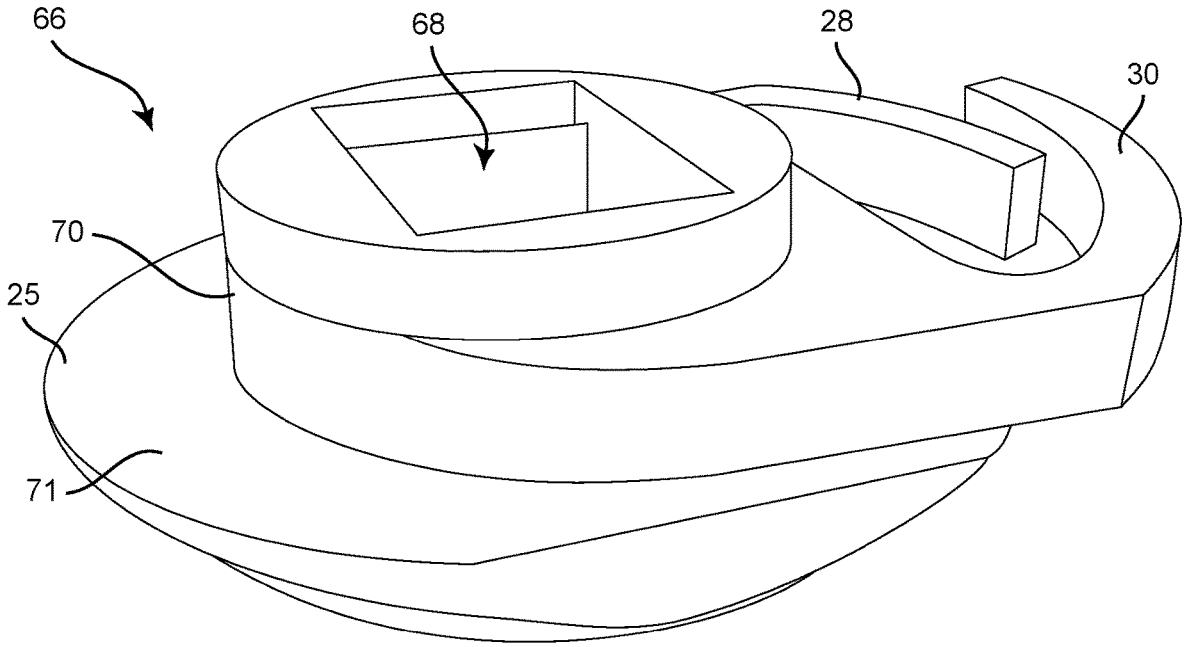
FIG. 15 is a top side front perspective view of a body of a bottom member.

FIG. 15 is a top side front perspective view of the body 66 of the bottom member 24 in greater detail. The body 66 has a member 70 with the slot 68 therein, and with the resilient members 28, 30 extending from the rear of the member 70. A lower portion 71 extends downward from the member 70, with the lower portion 71 having the top edge 25 which extends beyond the base 46 above the first side edge 35, as shown in FIGS. 6 and 8.

Figure 16:
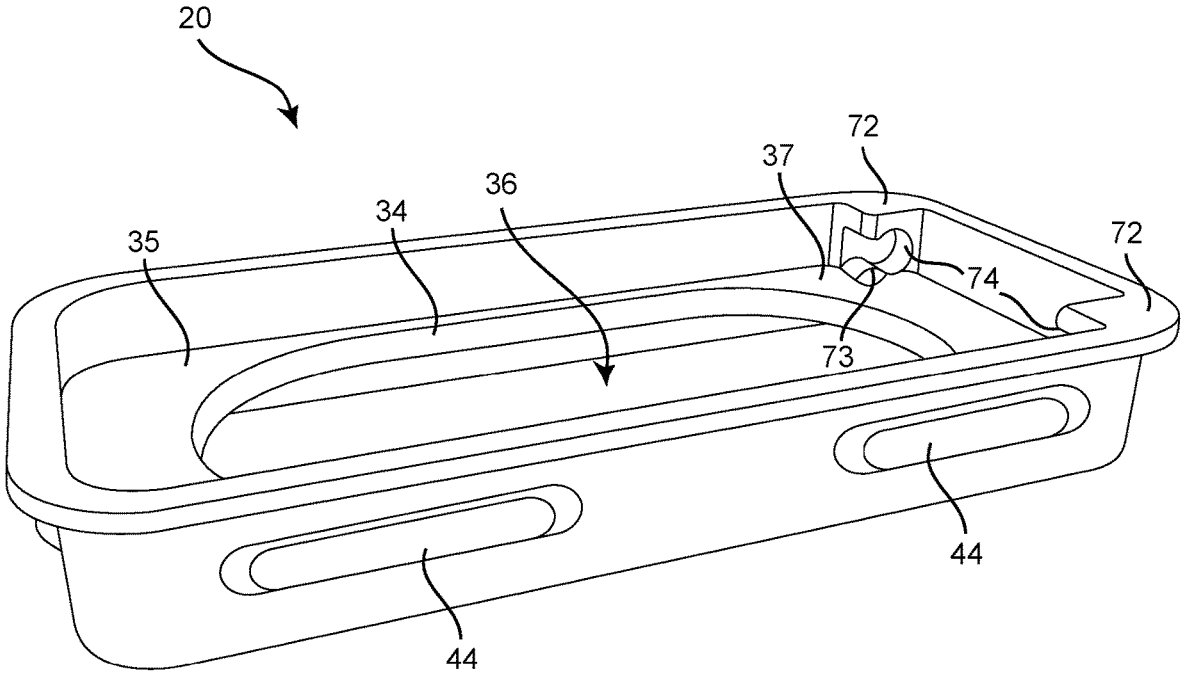
FIG. 16 is a top side front perspective view of a lower member.

FIG. 16 is a top side front perspective view of the lower member 20 in greater detail, with upper detents 72 and lower detents 73 forming respective hinge slots 74 proximal to the second side edge 37. Referring to FIG. 14, the hinge 22 includes hinge ends 76 of a hinge rod 78. The hinge slots 74 in FIG. 16 receive respective hinge ends 76 of the hinge rod 78, as shown in FIG. 14, in a snap-in engagement such that the hinge ends 76 rotatably engage the respective hinge slots 74, thus forming the rotatable hinge 22 as shown in FIGS. 3 and 10.

The container body 14 of the present invention is preferably constructed of tin but could be made from other metals or plastic. The components associated with the lid 12 are preferably constructed of injection molded plastic but also could be constructed of various metals. As described above, the container 10 of the present invention requires very few components and therefore manufacturing costs are greatly reduced. Also, the invention configuration of the container 10 allows a user to easily open the container 10 while maintaining a child resistant enclosure when in a locked configuration. As well, the present invention provides a discreet container that is child-resistant.

The present invention may be embodied in other specific forms without departing from its spirit or essential characteristics. The described embodiments are to be considered in all respects only as illustrative and not restrictive. The scope of the invention, therefore, will be indicated by claims rather than by the foregoing description. All changes, which come within the meaning and range of equivalency of the claims, are to be embraced within their scope.

What is claimed is:

1. A lid for engaging a container, the lid comprising:

a lower member having:

a hinge slot;

a side portion having at least one detent for engaging the container; and an interior portion having a top surface and a bottom surface, the interior portion comprising a lower aperture positioned directly above an opening of the container for establishing a passage from the container to an outside environment;

an upper member positioned within the lower member interior portion, the upper member having:

a rear portion having a hinge end rotatably coupled to the hinge slot of the lower member; and a front portion having:

an upper aperture extending through the front portion; and a base complementarily resting in the lower aperture;

an intermediate member extending upwardly through the upper aperture, the intermediate member comprising a resilient member on one end and an engagement member on an opposing end, the engagement member engaged to the lower member interior portion bottom surface; and a button member extending downwardly through the upper aperture, the button member connected to the intermediate member and responsive to a sliding force for sliding the intermediate member longitudinally toward the upper member rear portion;

wherein the intermediate member and button member are positioned directly above the lower aperture; and wherein sliding movement of the intermediate member in a longitudinal direction due to longitudinal movement of the button member causes the engagement member to disengage from the interior portion to allow the upper member to rotate about the hinge end to move the upper member front portion away from the lower member.

2. The lid of claim 1, wherein the side portion removably engages the the container.

3. The lid of claim 1, wherein the button member includes a ridge for allowing a user to grip the button member to apply the sliding force.

4. The lid of claim 1, wherein the upper member front portion further comprises an abutment extending between opposing walls of the base, the abutment engaging the resilient member for biasing the intermediate member longitudinally away from the upper member rear portion.

5. The lid of claim 4, wherein the resilient member biases the intermediate member to apply a restorative force opposite to the sliding force.

6. The lid of claim 5, wherein the resilient member restores the intermediate member to an initial position where the engagement member is engaged to the lower member interior portion when the sliding force is not applied to the button member.

* * * * *